US005350997A

United States Patent [19]

Ghotbi et al.

[11] Patent Number: 5,350,997

[45] Date of Patent: Sep. 27, 1994

[54] STEP-UP VOLTAGE CONVERTER WITH OVERCURRENT PROTECTION

[75] Inventors: Mohammad-Reza Ghotbi, Rochester, Minn.; Tony R. Larson, Tucson, Ariz.

[73] Assignee: International Business Machines Corporation, Armonk, N.Y.

[21] Appl. No.: 990,997

[22] Filed: Dec. 16, 1992

[51] Int. Cl.[5] ..... G05F 1/44

[52] U.S. Cl. ..... 323/268; 323/222; 363/49; 363/59; 361/87

[58] Field of Search ..... 323/268, 269, 270, 271, 323/272, 222, 350; 363/49, 59, 15, 16; 361/18, 79, 87, 93

[56] References Cited

U.S. PATENT DOCUMENTS 4,344,122 8/1982 Jones ..... 363/23

5,233,287 8/1993 Lenk ..... 323/268

*Primary Examiner*—Steven L. Stephan

*Assistant Examiner*—Adolf Berhane

*Attorney, Agent, or Firm*—Benman Collins & Sawyer

[57] ABSTRACT

A step-up converter is utilized to convert a first lower input voltage to a second higher output voltage. The circuit includes a soft start capability such that ringing due to excessive voltage and current is substantially eliminated. In addition, this converter includes an overcurrent protection mechanism if a load failure or other overcurrent condition occurs.

19 Claims, 12 Drawing Sheets

STEP-UP VOLTAGE CONVERTER WITH OVERCURRENT PROTECTION

FIELD OF THE INVENTION

The present invention relates to step-up voltage converters and more particularly to voltage converters that include overcurrent protection and soft start capability.

BACKGROUND OF THE INVENTION

Switched mode step-up converters are utilized in a variety of electronic equipment in which an output voltage is required and is larger than the input voltage provided.

A step-up converter is used for example in AC/DC or so-called bulk converters in high voltage equipment and DC to DC converters that is utilized oftentimes in portable equipment.

The AC/DC bulk converter is usually provided in power factor-corrected equipment where the AC voltage is fed to a step-up converter and through proper control the input current is made to be nearly sinusoidal and in phase with the input voltage. The portable applications involve running the equipment from a voltage source of limited voltage range such as a battery. Since in most cases a voltage level higher than the voltage available from the batteries is required a step-up converter is used to generate a secondary voltage. This secondary voltage may oftentimes be used to drive displays, disk drives, etc., in computer equipment.

To more particularly understand a prior art conventional step-up converter refer now to FIG. 1. The conventional step-up converter 10 includes an inductor 12, one end of which is coupled to the positive end of the voltage source ($V_i$) 13, the other end of inductor 12 is coupled to one end of switch 14. The other end of the switch 14 is coupled to the negative terminal of $V_i$ 13. A diode 16 is coupled to the inductor 12. The output of diode 16 is coupled to one end of capacitor 18. The other end of capacitor 18 is coupled to the input in parallel fashion to one end of switch 14. A resistor 20 is coupled in parallel to the capacitor 18. Resistor 20 is a load resistor across which the output voltage is measured. A control system 22 controls the operation of switch 14. The circuit 10 operates in the following manner.

The voltage source Vi 13 represents a voltage source that may be either AC or DC depending upon the application. The inductor 12 repeatedly transfers energy from the input to the output as the switch 14 is opened and closed by control system 22. The control system 22 determines the status of switch 14. The output capacitor 18 reduces the ripple on the output voltage wherein the resistor represents the load. Typically switch 14 may be implemented as a power MOSFET, BJT or some other type of power switching transistor.

This type of converter, although it works well for some applications, has some significant problems. Assuming that the converter is off, that is, the switch 14 is open and the input voltage is 0 initially, after a sufficient period of time the output voltage will also be zero. In this state the converter 10 is completely deenergized. If the input voltage is applied in a step manner such as closing a master switch on an AC box or a portable computer, then the inductor 12 and the capacitor 18 form a resonant circuit. It has been shown that the output voltage will overshoot to substantially twice the input voltage before settling down to its steady state value. This overshoot can cause significant problems in that this increased voltage can cause damage to the components therein.

In addition, a large inrush current will be conducted through inductor 12 which can cause a magnetic flux saturation in the core of the inductor 14. The large inrush current may also lead to the destruction of various components in the converter. Finally, the initial position of switch 14 can complicate matters if switch 14 is closed during start up. The inrush current will build up rapidly in the inductor 12 which could lead to the destruction of both the inductor 12 and the switch 14.

As was mentioned above, if switch 14 is in the open position there is a problem of a voltage overshoot and in-rush current. An additional diode 24 is sometimes added between the input voltage and the capacitor to bypass the flow of the initial charge current of the capacitor through the inductor 12. The addition of the diode 24 does lessen the inductor 12 start up problems, but significantly increases the large in-rush current associated with this type of converter 10. Such large currents can lead to premature and false triggering of circuit breakers or the like which often produce failure of other sensitive loads.

Other problems with large in-rush currents are increased power consumption, component stress, and interaction with other loads connected to the input voltage sources.

Another problem with the above-mentioned prior art converter 10 is that there is no protection for the components if excessive current is presented to the converter 10. This becomes a problem when the load resistor 20 is suddenly reduced due to a short circuit, load damage or a like problem. The step-up converter 10 shows a loop formed by the input voltage source 13, inductor 12, step-up diode 16, and the load resistor 20. Since the load resistor 20 is suddenly reduced, the power is continuously drained from the input voltage source regardless of the condition of switch 14 and the inductor 12 current builds up to dangerous and destructive levels. When the output load resistor 20 is damaged, an error could occur that causes the output to be shorted.

Damage to the inductor 12 is almost certain. In addition, switch 14 will be destroyed if it is turned on after the inductor current has built up to a high level. If the cause of the output overcurrent is a mistake by service personnel or the like, the safety of the service personnel is very important, especially in the AC/DC frontend converter application. In such applications, the output voltage of the step up converter is typically in the 380–400 volt range.

Accordingly what is needed is an improved step-up converter which has soft start capability. That is, have the capability to be turned on at a first voltage level until it reaches a steady state position. It is also important that a converter be provided that does not have the large inrush current problems associated with prior art converters. In another aspect, a step-up converter is needed that has overcurrent protection that can protect the devices of the converter when there is a load failure of some sort. It is also important that such a converter be utilized and have the same characteristics as prior art converters. It is also important that the converter be simple and easily implemented into a variety of electronic applications. The present invention provides a converter that has the above-mentioned features.

DETAILED DESCRIPTION OF THE DRAWINGS

The present invention is directed toward a circuit for a step-up converter for converting one voltage level to another voltage level. The following description is presented to enable one of ordinary skill in the art to make and use the invention and is provided in the context of a patent application and its requirements. Various modifications to the preferred embodiment will be readily apparent to those skilled in the art and the generic principles and features described herein.

Figure 1:
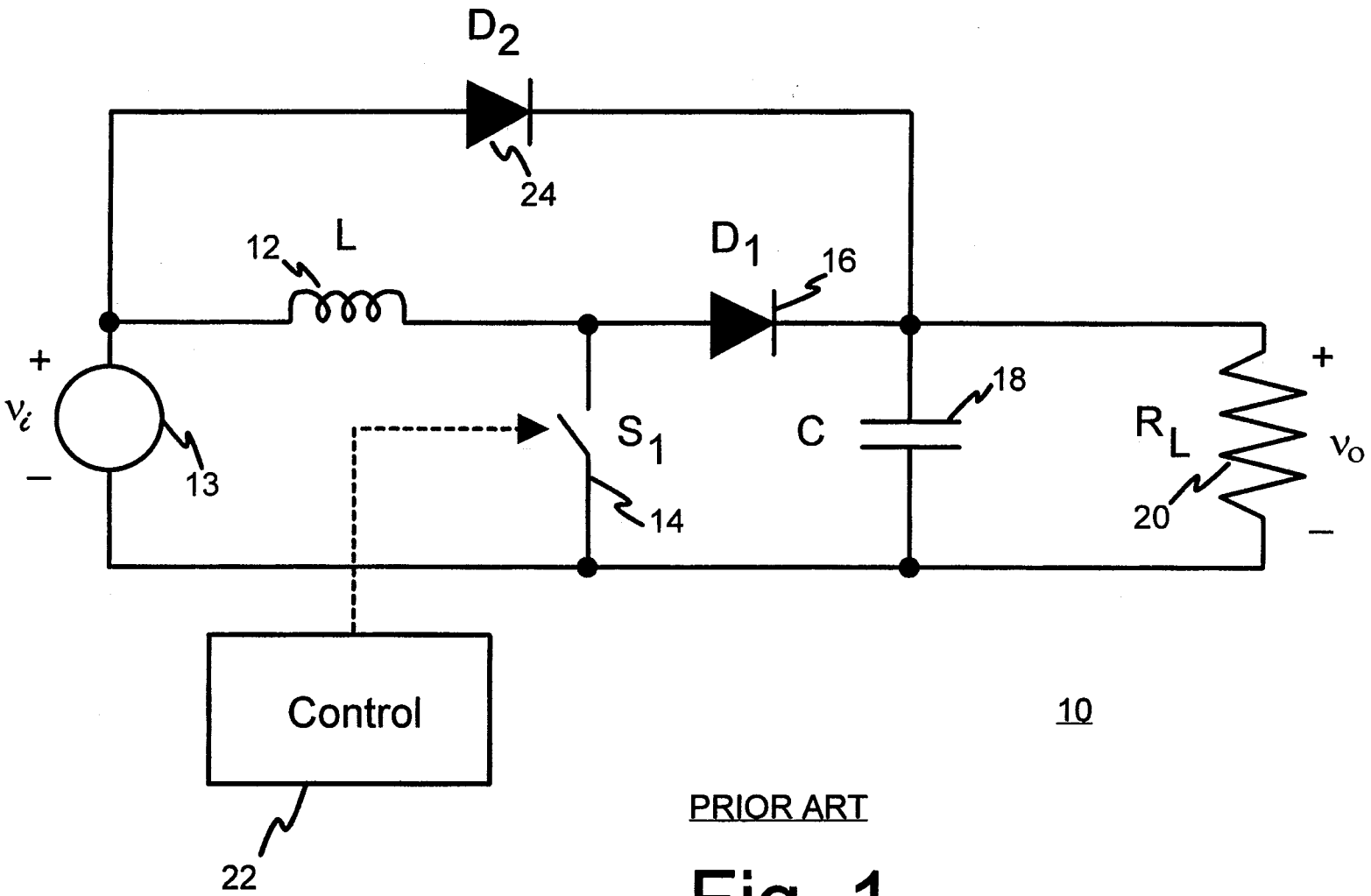
PRIOR ART Fig. 1
FIG. 1 is a diagram of a conventional step-up converter.
Figure 2:
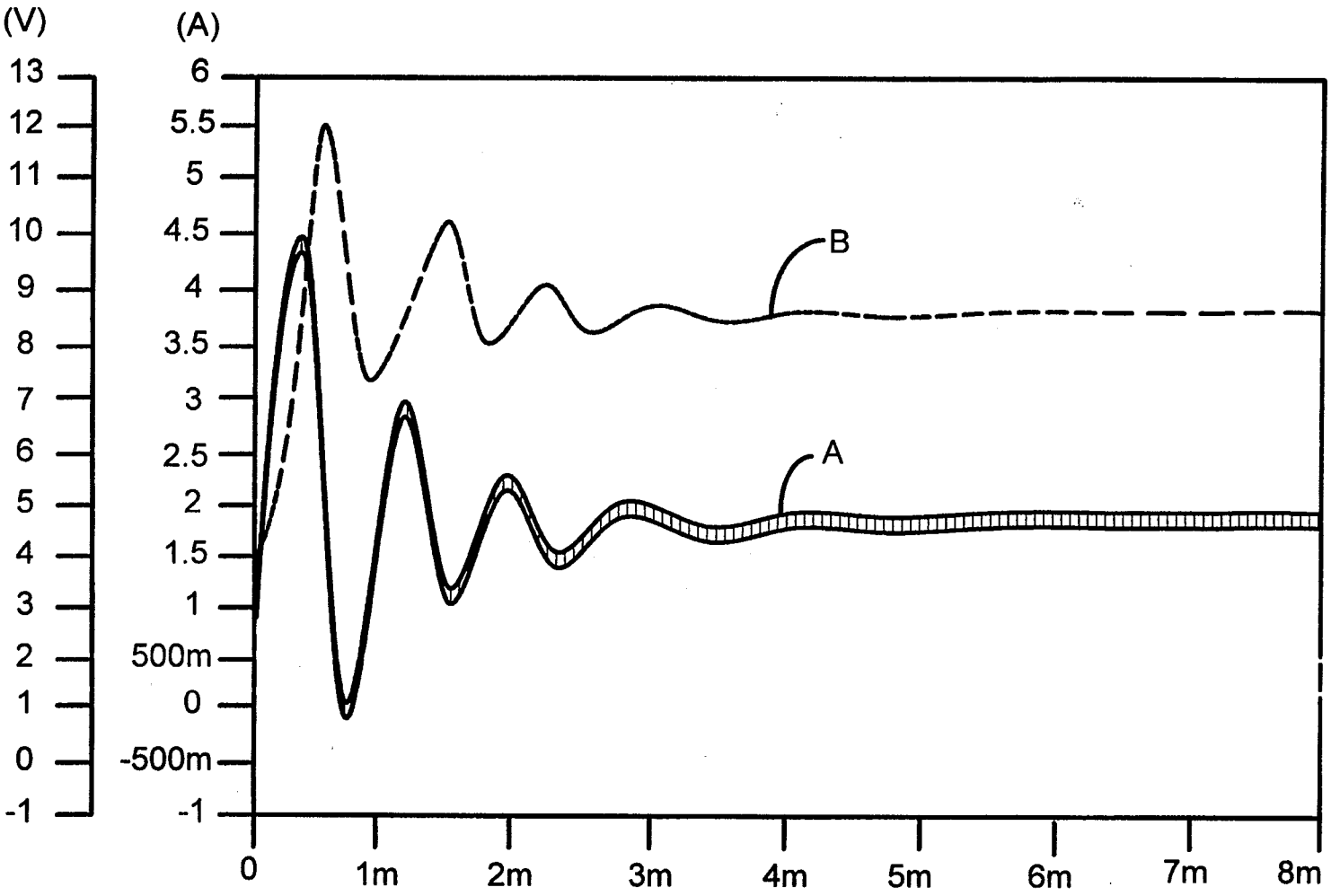
FIG. 2 is a diagram showing the start up waveform for a convention step up converter that exhibits excessive ringing.

What is needed is a system for preventing the excessive ringing or like of input voltage and current during the start up as shown in and FIG. 2. As can be seen from this Figure, both of the waveforms A and B (current and voltage waveforms respectively), exhibit overshoot and oscillations associated with the circuit 10 of FIG. 1, giving rise to instantaneous input currents and output voltages that may be several times their steady state values. The problems encountered with this arrangement were described in the Background of the Invention and include large inrush current, and a large output voltage which can be detrimental to the load. As was before-mentioned the large inrush current can lead to premature and false triggering of components and the large swing in voltage can lead to damage to the electrical circuit preconnected to the output converter.

Figure 3:
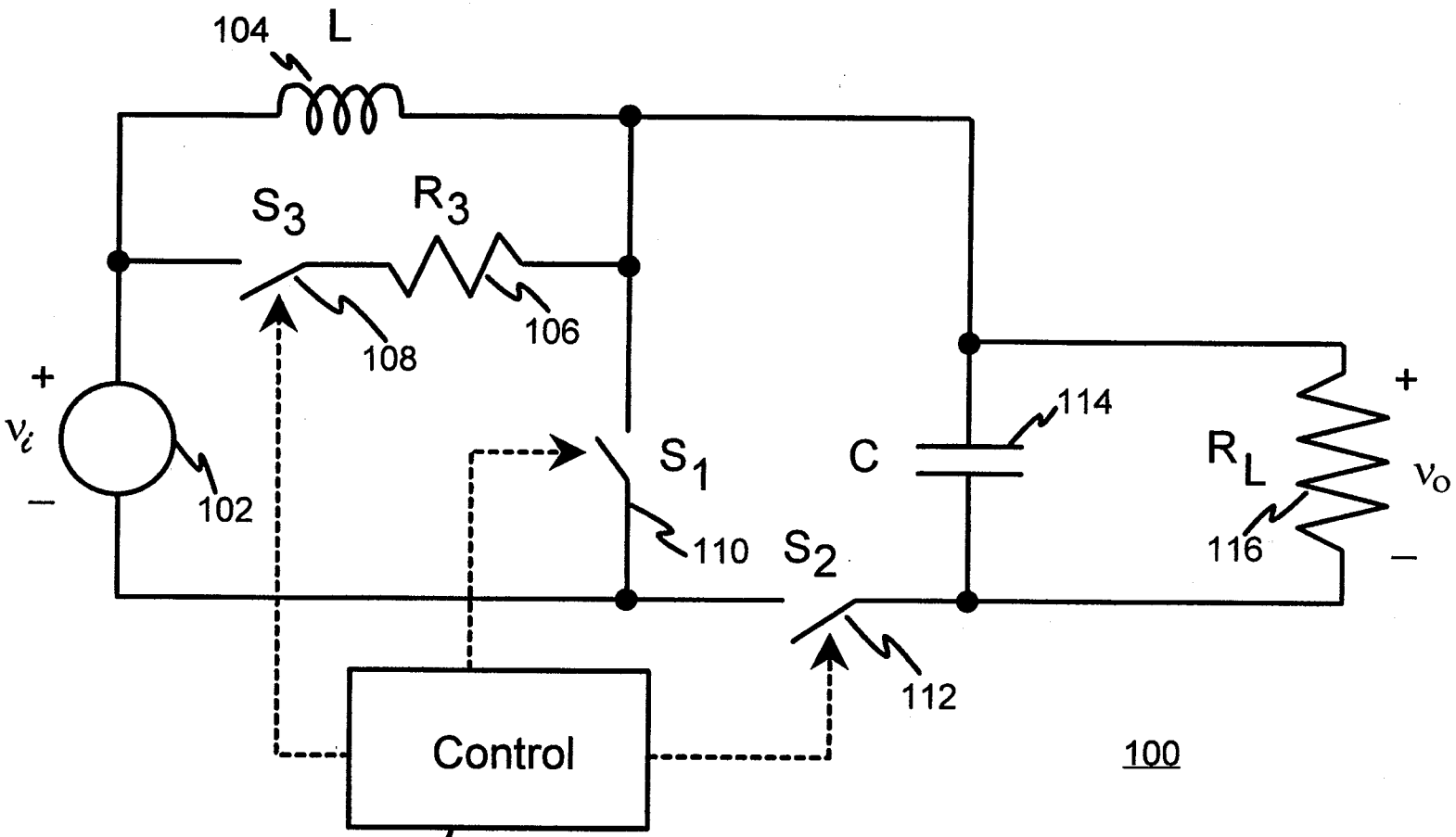
FIG. 3 is a circuit diagram of a step-up converter in accordance with the present invention.

These problems are addressed by converter 100 of FIG. 3, which shows the converter 100 in block diagram form. The converter 100 comprises a voltage source 102 whose positive terminal is coupled in series with an inductor 104 and switch 110. The other end of the inductor 104 is coupled to one end of the resistor 106. The other end of resistor 106 is coupled to the switch 108. The negative terminal of the input voltage source 102 is also coupled to a switch 110 which is in turn coupled to the resistor 106 and inductor 104. The switch 110 is coupled to one end of a switch 112. The other end of the switch 112 is coupled to one end of the capacitor 114. The inductor 104 is also coupled to the other end of the capacitor 114. A load resistor 116 is coupled in parallel fashion to the capacitor 114. The output voltage is measured across the load resistor 116. All of the duty cycles of the switches 108, 110 and 112 are controlled by a control system 122. The operation of the new converter 100 is described below.

Switches 110 and 112 are used during the normal operation of the converter 100. Switch 108 is activated during both start up and overcurrent protection modes. During normal operations switches 110 and 112 are operating in a complementary fashion, that is when switch 110 is closed, switch 112 is open, and vice versa. If switch 110 is operated with the duty cycle of $D_1$, then the duty cycle equals $$\frac{t_{on1}}{T_S},$$

where $t_{on1}$ is the time duration that switch 110 is on, and $T_S$ is the complete period of the switching frequency of the switches 110 and 112.

During steady state operation the average volts across inductor 102 must equal zero. Utilizing this restriction, the output voltage of the converter 100 as a function of the input voltage and the duty cycle is given by $$v_0 = \frac{1}{1 - D_1} v_i$$

This is the same relationship as for a conventional step-up converter.

Figure 4:
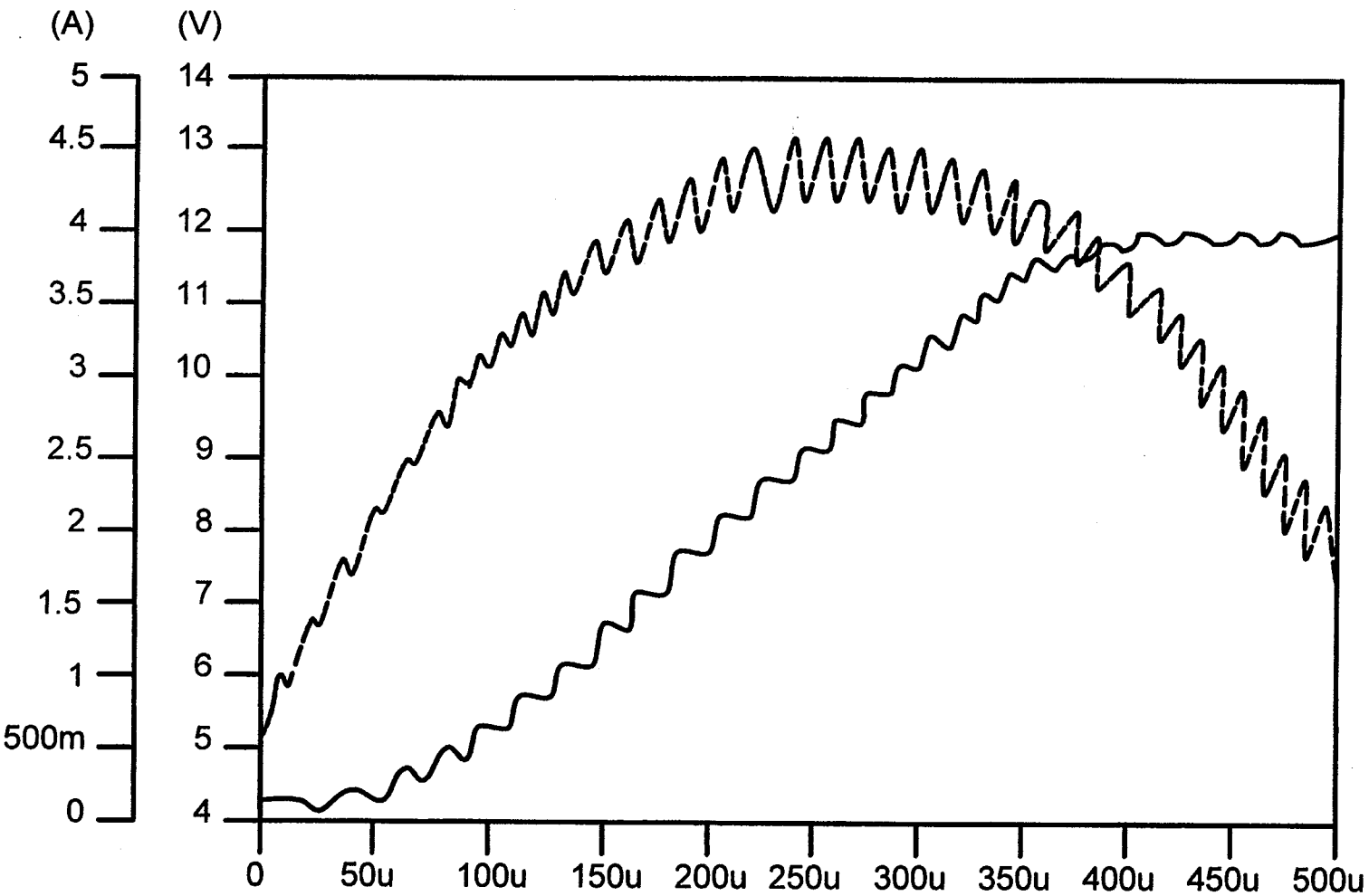
FIG. 4 shows voltage and current waveforms for a conventional converter.
Figure 5:
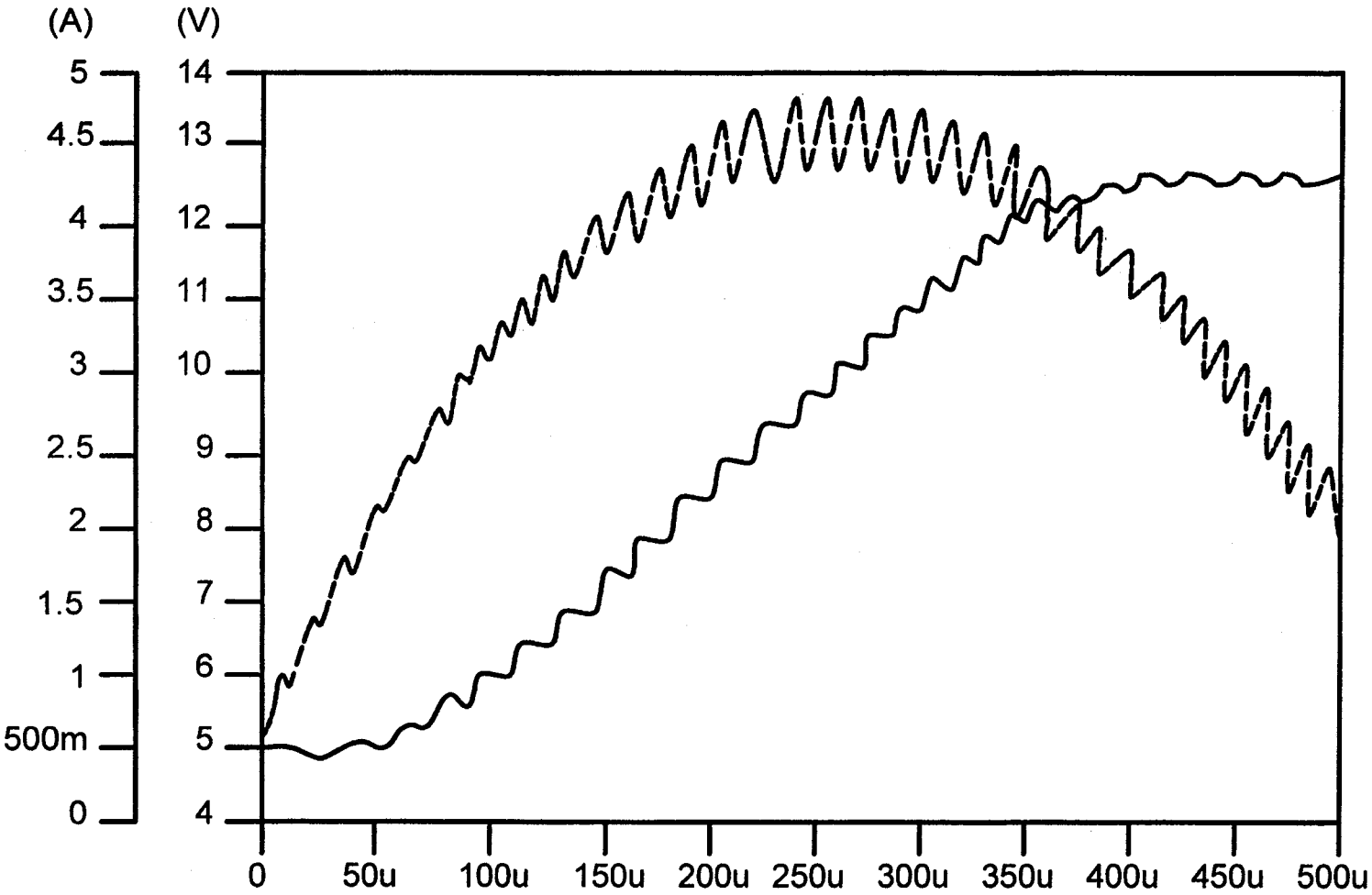
FIG. 5 shows voltage and current waveforms for the converter in accordance with the present invention during normal operation.

Referring now to FIGS. 4 and 5 what is shown is typical inductor current and output voltage waveforms for the conventional step-up and the proposed converter during steady state operation. As was before mentioned in FIG. 1, however, with the conventional converter during start up the waveforms exhibit overshoot and oscillations, which gives rise to instantaneous input currents and input voltages.

In the converter 100 of the present invention, switch 108 was added to provide soft start and overcurrent protection operation. The soft start operation cannot be accomplished by merely using the two switches 110 and 112. The inductor current cannot be dampened in a controlled way by closing either 110 or 112. Closing 110 and opening 112 will increase the inductor current due to the input voltage. On the other hand, opening 110 and closing 112 forms a resonant circuit consisting of inductor 104 and capacitor 114. This resonant circuit is dampened by the load resistor 116. However, this damping is not controllable, since the load resistor 116 is fixed by application.

Therefore, the input current and output voltage would respond as a substantially underdamped second-order system, similar to a conventional step-up converter. The way a soft start operation is accomplished is by initially opening switch 110 during the start up cycle. The soft start cycle is divided into two distinct steps. The first step proceeds in the following manner: with switch 110 open, switch 112 and 108 are operated in a complementary fashion. Initially, switch 108 is operated with the duty cycle $D_3$ which is small, that is, $D_2=1-D_3$ where $D_2$ is the duty cycle of switch 112. The duty cycle of switch 108 is then increased toward unity until the output voltage is nearly equal to the input voltage. When this occurs the first soft cycle step is completed and the control is passed on to the second cycle step.

Figure 6:
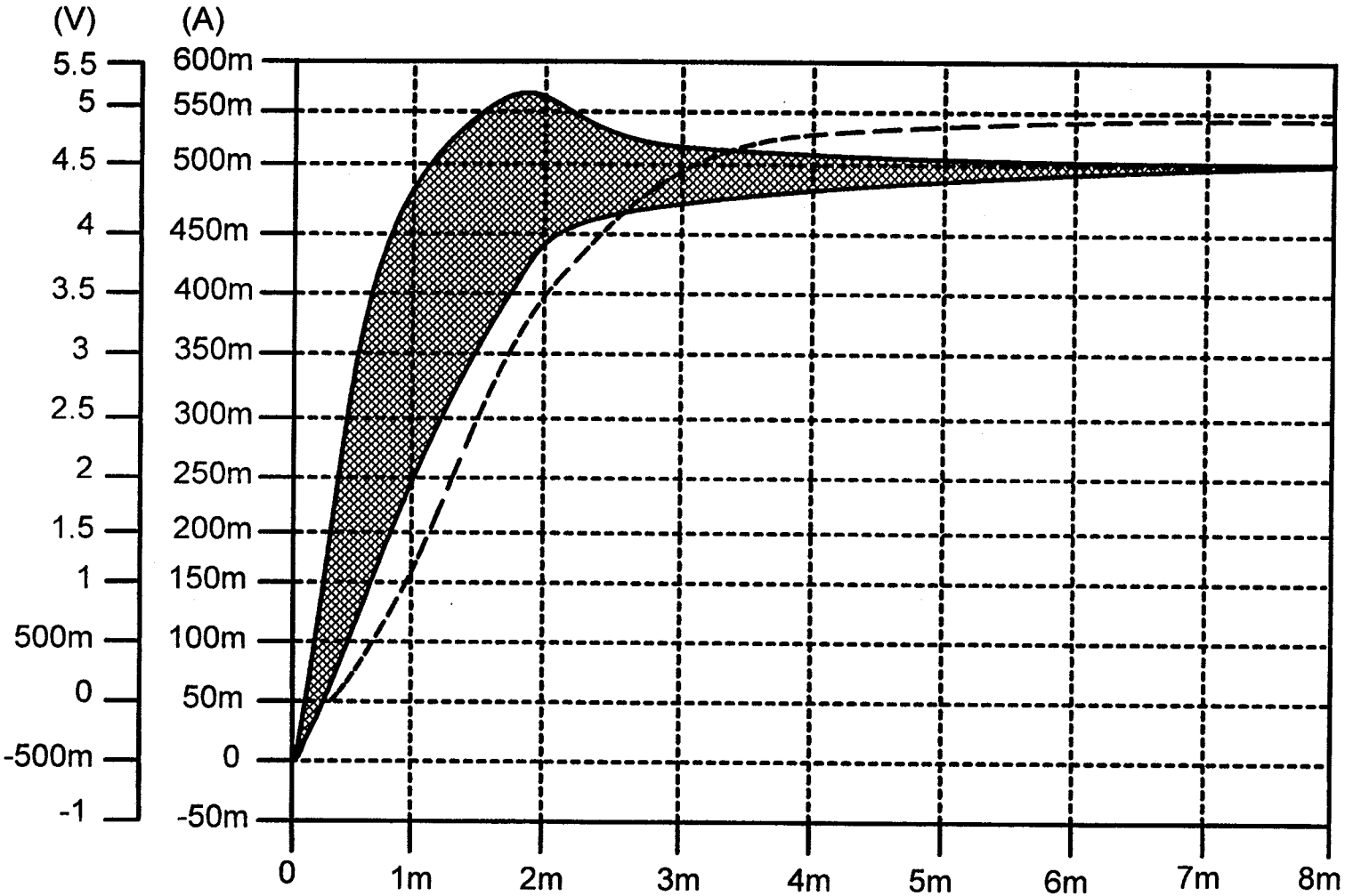
FIG. 6 is a waveform showing the inductor current and output voltage of the converter of FIG. 3 during the first soft start cycle step.

Referring now to FIG. 6, a typical waveform for the inductor current and output voltage under the first start cycle are shown. The control signals for switches 112 and 108 are obtained by comparing an exponential voltage, which may be generated by a resistor-capacitor network, with a sawtooth Pulse-Width Modulation (PWM) ramp with a frequency $f_s$ (100 kHz, for example). As is evident in the figure, the inductor (input) current and the output voltage exhibit substantially no overshoot or ringing, and are well behaved. Note that the inductor current and output voltage are not yet at their final steady state operation values. The inductor current and output voltage will reach their final values during the second soft start cycle. Also note that resistor 106 is used to dampen the inductor current during start up. A properly chosen value of this resistor 106 ensures controlled initial activation of the converter.

During the first soft start cycle, when switch 112 is opened and switch 108 is closed, assuming that the initial inductor current and capacitor voltage are $I_{LO}$, and $V_{CO}$, respectively, gives:

$$i_L(t)=I_{LO}\, e^{-t/\tau_1},$$

$$v_C(t)=V_{CO}\, e^{-t/\tau_2},$$

where $$\tau_1 = \frac{L}{R_S},$$

$$\tau_2 = R_L C.$$

When the switches are in the complementary state, that is, switch 112 is closed and switch 108 is open, the analytical relations governing the inductor current and output voltage are given by $$i_L(t) = \frac{V_i}{R_L} + K_1\, e^{-\alpha} \sin \omega_d t + K_2\, e^{-\alpha} \cos \omega_d t,$$

$$v_C(t) = V_i + K_3\, e^{-\alpha} \sin \omega_d t + K_4\, e^{-\alpha} \cos \omega_d t,$$

where $$\alpha = \frac{1}{2 R_L C},$$

$$\omega_d = \sqrt{\frac{1}{LC} - \frac{1}{(2 R_L C)^2}},$$

and $K_1$–$K_4$ are constants that are functions of $v_i$,L,C,$R_L$,$I_{LO}$, and $V_{CO}$ (the initial conditions of the two states).

As mentioned above, the second soft start cycle step commences at the end of the first soft start cycle. Here the strategy is: modulate the PWM ramp with another voltage, whose final (steady state) value results in $D_1$, or the nominal duty cycle for switch 110 during steady state operation. The key point is that switch 108 is opened during this cycle (and remains open unless an overcurrent fault occurs), with switches 110 and 112 are now operated in a complementary fashion.

Note that during both soft start cycle steps the converter 100 is operated in an open-loop manner (with no feedback of output voltage or other states to the control subsystem). In most applications, a closed negative feedback loop is established to regulate the output voltage (and/or the input current). At the end of the second soft start cycle step, the loop may be closed if desired (by the control subsystem 122).

Figure 7:
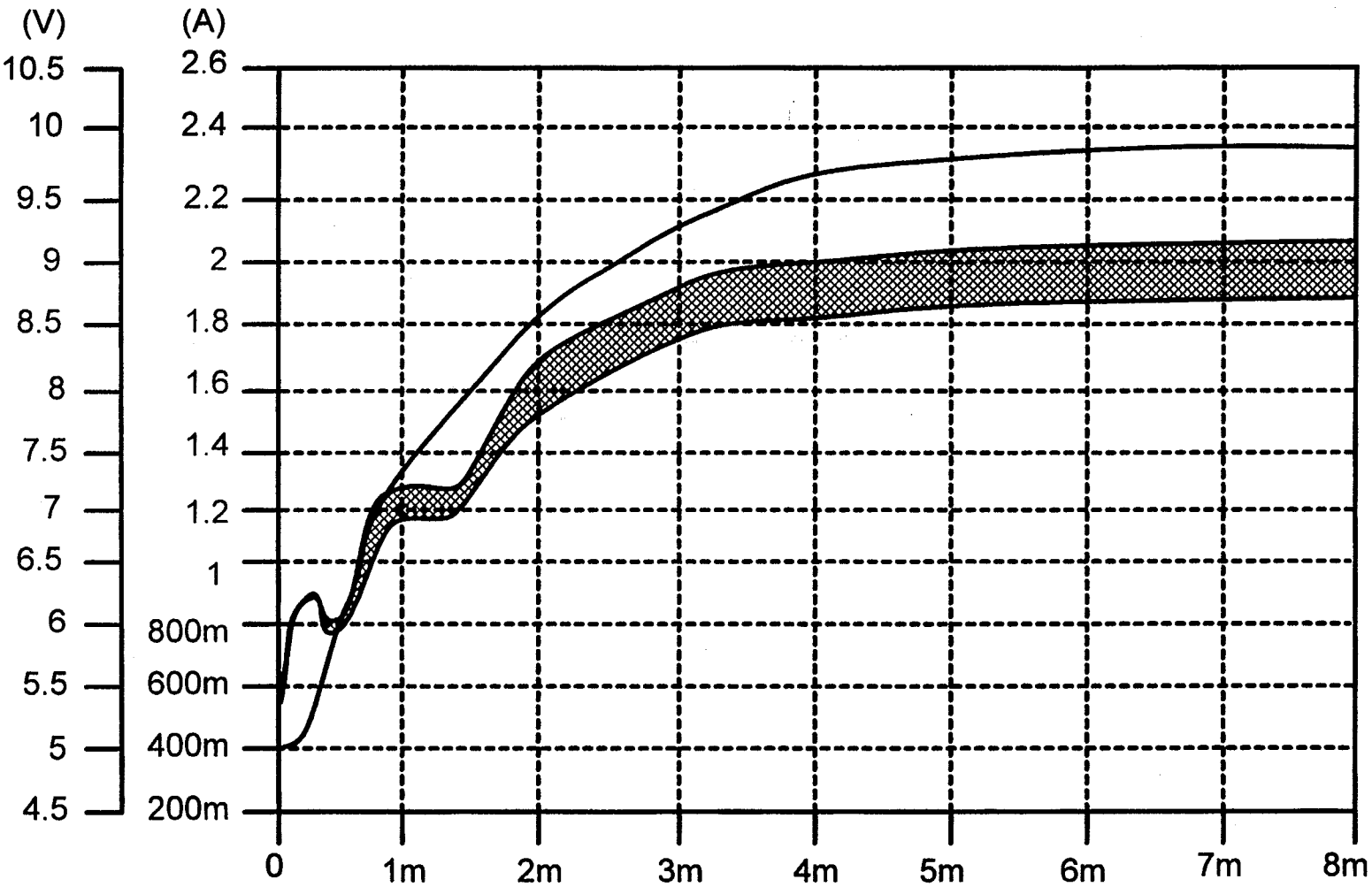
FIG. 7 is the waveform for the inductor current and output voltage of the converter of FIG. 3 during the second soft start cycle step.

Typical waveforms for the second soft start cycle step are shown in FIG. 7. An exponential voltage generated by a resistor-capacitor network was used as the modulating voltage for PWM control. Note that the overall soft start cycle is a cascade (in time) of the waveforms in FIGS. 6 and 7.

Figure 8:
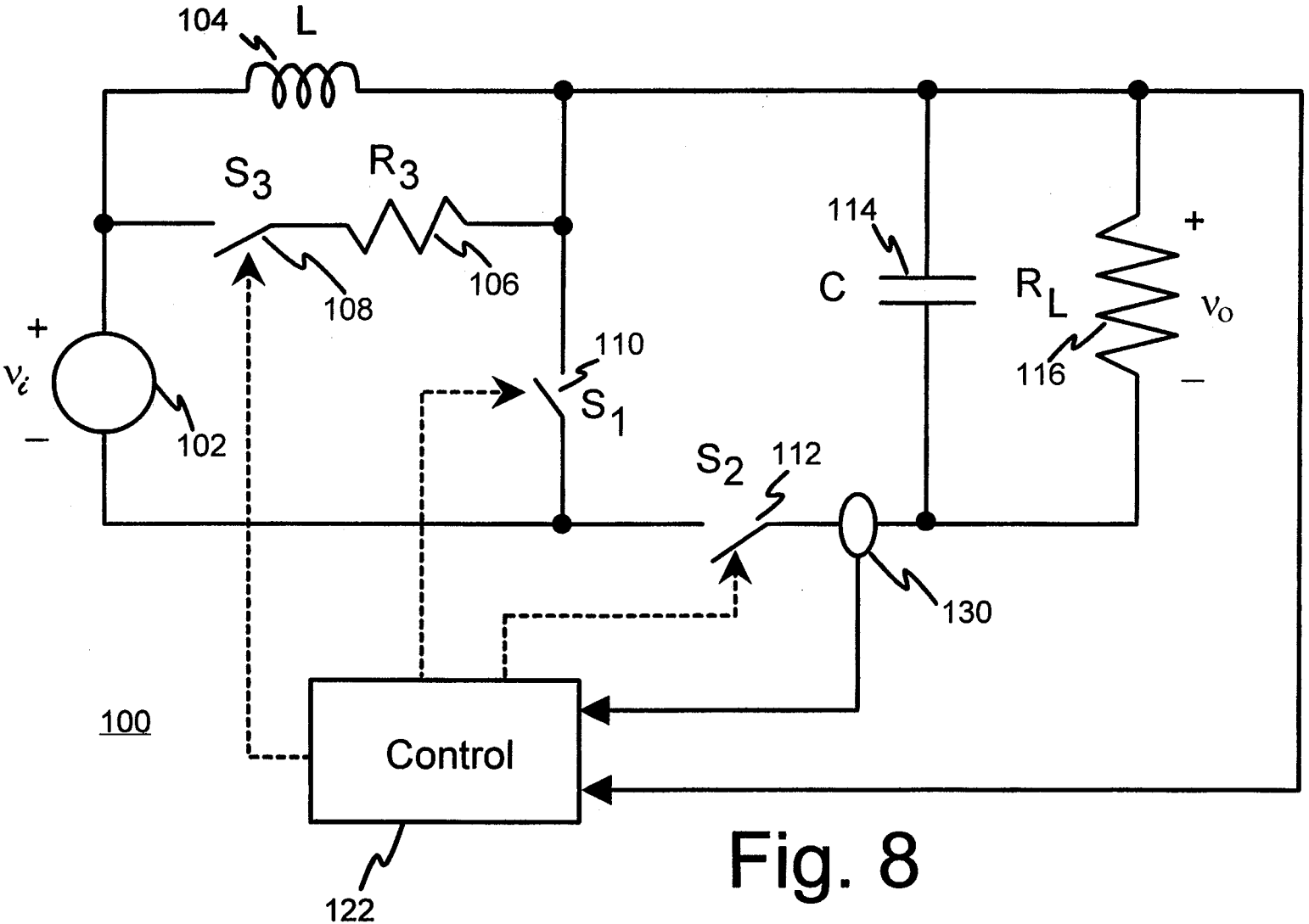
FIG. 8 is the proposed converter with enhancements for overcurrent protection.

The converter 100 also provides the facility for overcurrent protection. In order to implement overcurrent protection, it is necessary to sense the output current. The proposed converter provides a convenient current sensing point 130 at switch 112, as shown in FIG. 8. Note the current sensor 130 in this Figure senses the output current of the converter, and makes this information available to the control subsystem.

There are several ways of sensing the converter output current. In a version of the converter where discrete devices are employed, one may use a current-sensing transformer or resistor to accomplish this. In integrated versions of the converter employing power MOSFETs, one may use a pilot sensing FET to sense the output current.

It should be noted that if power MOSFETs are used as the main power switches in the converter, then two diodes should be added in series with switch 108 and switch 112 to prevent current sneak paths. The addition of diodes may not be necessary if other kinds of switches are used. If a highly accurate threshold at which the overcurrent protection circuit is activated is not required, then a pilot FET may be used. This method has been previously used in manufacturing power MOSFETs with current sense capability.

Figure 9:
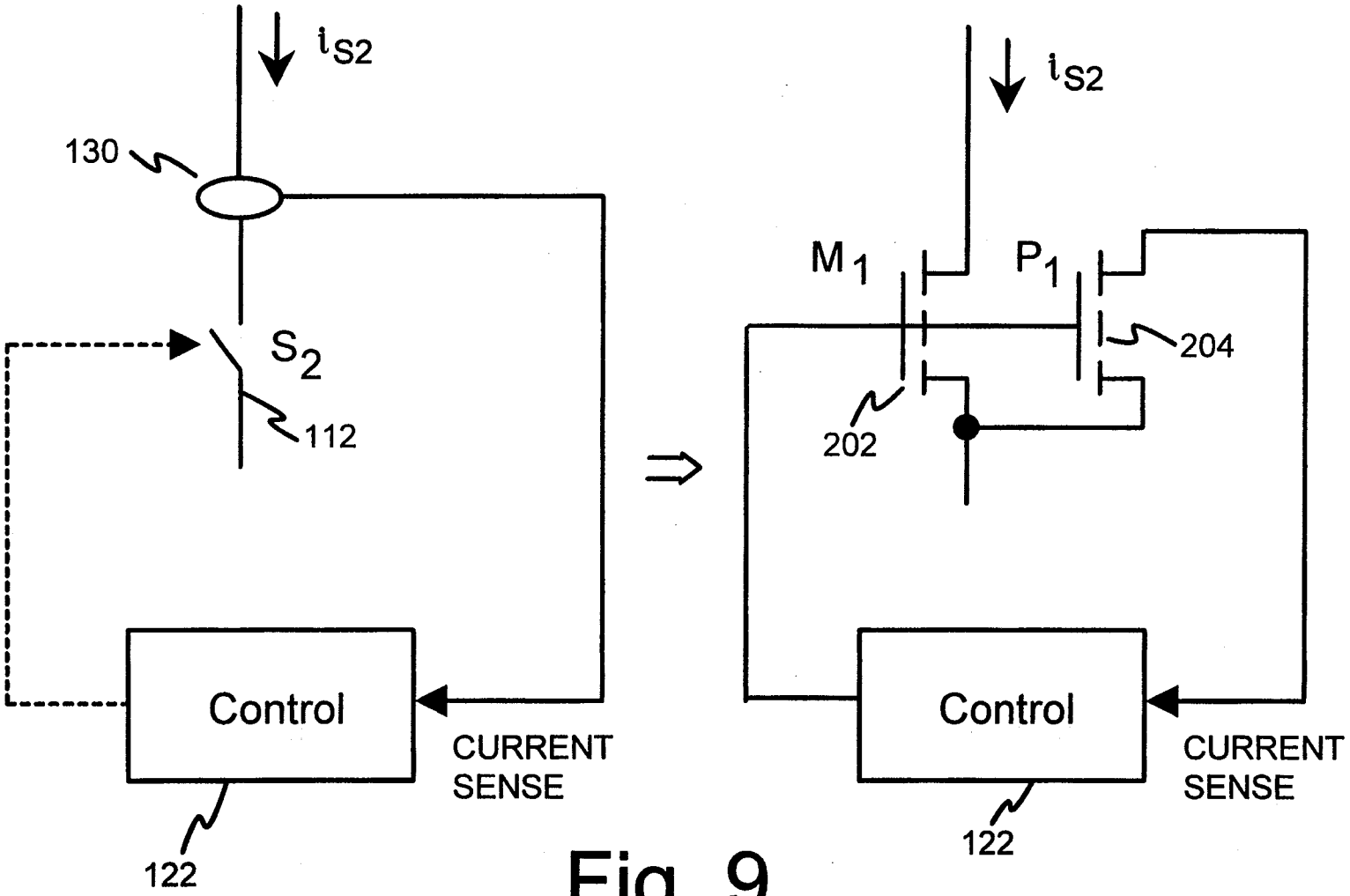
FIG. 9 is circuitry that may be used to provide the sensing circuit for the current.

If, on the other hand, the application requires a more precise control of the overcurrent threshold, an arrangement such as that shown in FIG. 9 can be used. Transistors 202 and 204 represent the pilot and main power MOSFETs in this figure. Active circuitry must be used in the control subsystem to assure that the drain voltage of the pilot FET 202 is substantially at the same potential as that of the main power FET 204. A circuit that accomplishes this is described in detail in U.S. patent application Ser. No. 08/096,863, entitled, Measurement of load current in a multiphase power amplifier, now U.S. Pat. No. 5,285,143, and is assigned to the assignee of the present application.

Figure 10:
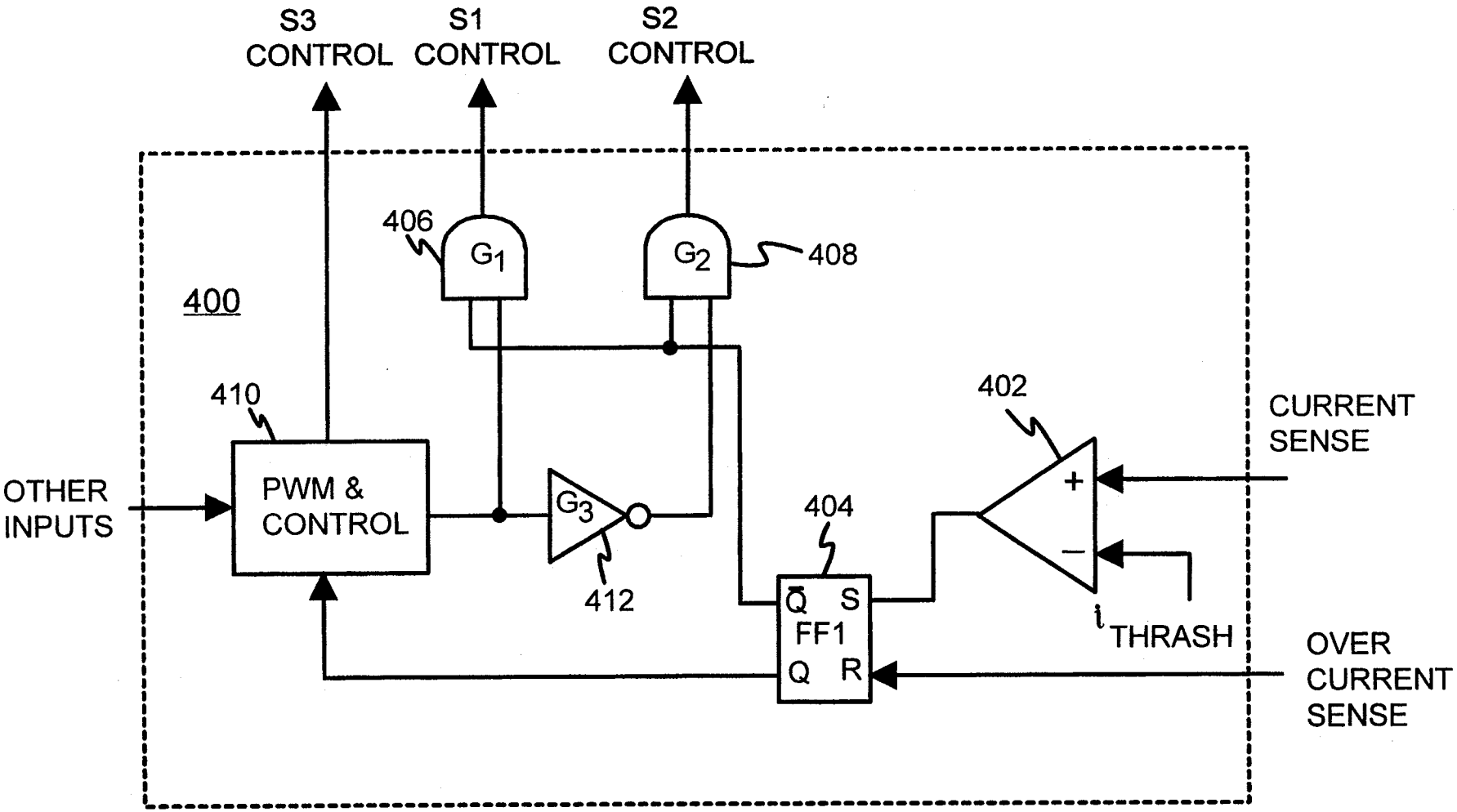
FIG. 10 is an overcurrent shutdown circuit.

Once an overcurrent condition is detected, two actions may be taken: either the converter is shut down until the fault at the output is removed and the converter is reset, or alternatively, the converter may continue to operate, albeit at an output current level determined by a preprogrammed threshold value. A circuit 400 that allows the converter 100 to perform overcurrent shutdown is shown in FIG. 10.

In this circuit 400, the output current is sensed (using one of the methods mentioned above, or other methods), and is compared to the threshold current, $i_{thresh}$. The output of the comparator 402 feeds the SET input of a flip-flop 404. Under normal circumstances, the Q output of the flip-flop 404 is logic low (false), and its $\overline{Q}$ output is logic high (true).

Therefore, AND gates 406 and 408 allow the normal control signals from PWM and control 410 via inverter 412 for switches 110 and 112 to be routed to the respective switch drivers. As soon as the output current exceeds the threshold current, the output of the comparator 402 goes to logic high, thus setting the flip-flop 404. The $\overline{Q}$ output of the flip-flop 404 is forced to logic low, inhibiting gates 406 and 408.

These gates in turn assure that switches 110 and 112 are turned off by overriding their normal control signals. The function of the inverter 412 is to assure the normal control signals for switches 110 and 112. This allows the discharge of the magnetic field set up in the inductor 12 (FIG. 3) through the damping resistor 106. The charge on the output capacitor 116 will also be drained via the load.

Figure 11:
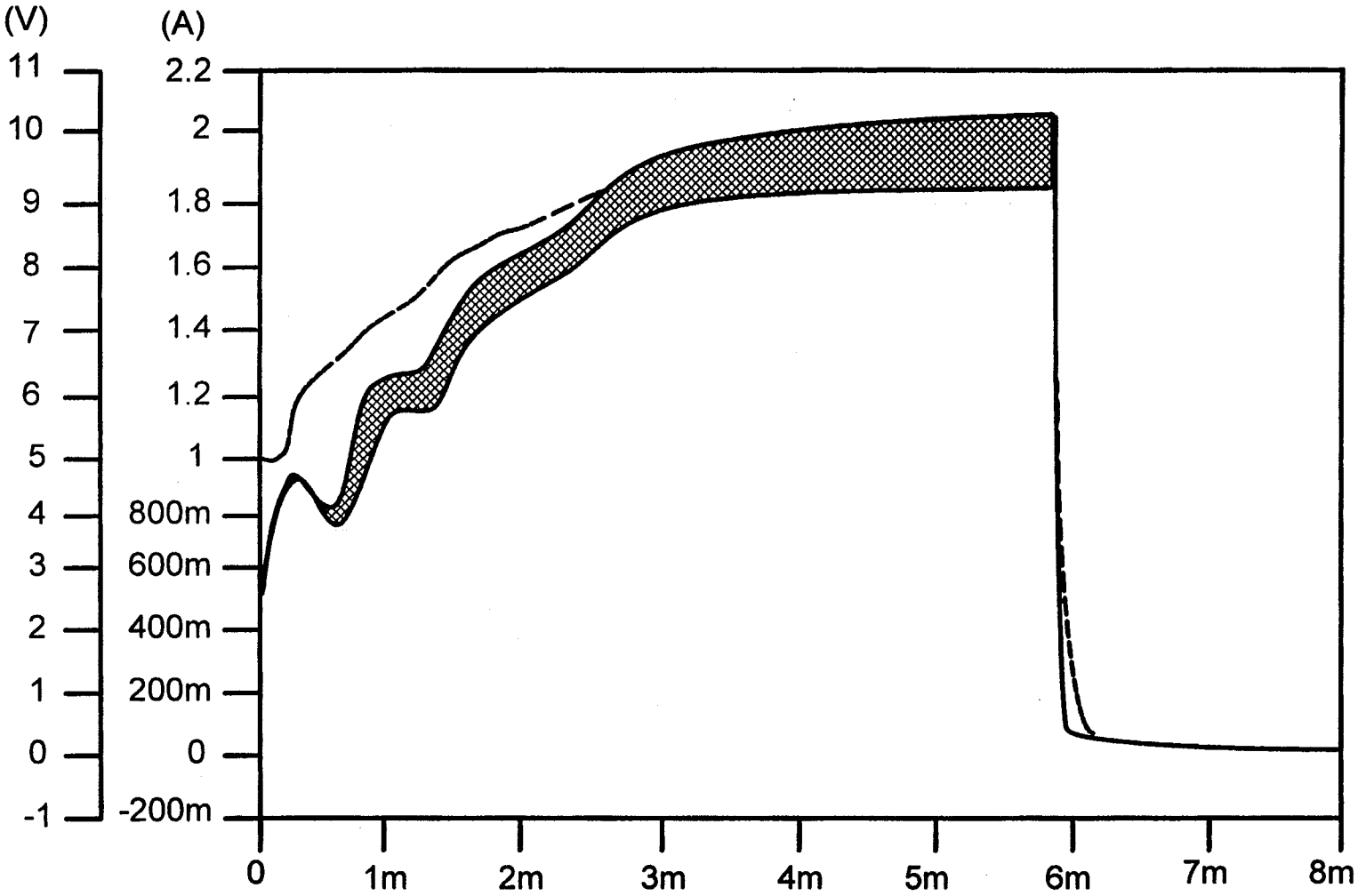
FIG. 11 depicts the waveform during overcurrent shutdown of the converter during the second soft start cycle.

Typical waveforms for the overcurrent shutdown of the proposed converter are shown in FIG. 11. Here, a load fault is assumed to occur during the second soft start cycle. Note that the inductor current and output voltage rapidly decay to zero as the result of the activation of the overcurrent shutdown circuitry. The overcurrent shutdown can be reset by applying a true logic signal to the R (reset) input of the flip-flop 406. This signal may come from a supervisory circuit, host, etc., or it may be a manual override, depending on the particular application.

Note that if overcurrent shutdown is used, switch 108 does not have to be implemented by a large semiconductor device on a large heat sink. Instead, it can be a substantially small device cooled through natural convection. The reason for this is that switch 108 is only used during start up (typically only a few milli-seconds) and during overcurrent shutdown (also typically on the order of a few milli-seconds). As mentioned above, overcurrent limiting can also be implemented in the proposed new converter. The control circuitry must be modified to perform PWM of the control signal for switch 108 as well as those of switch 110 and 112. By repeatedly charging the inductor 106, damping it using the switch 108 and resistor 106 combination, and transferring its energy to the output, one may limit the output current to a level dictated by $i_{thresh}$.

Figure 12:
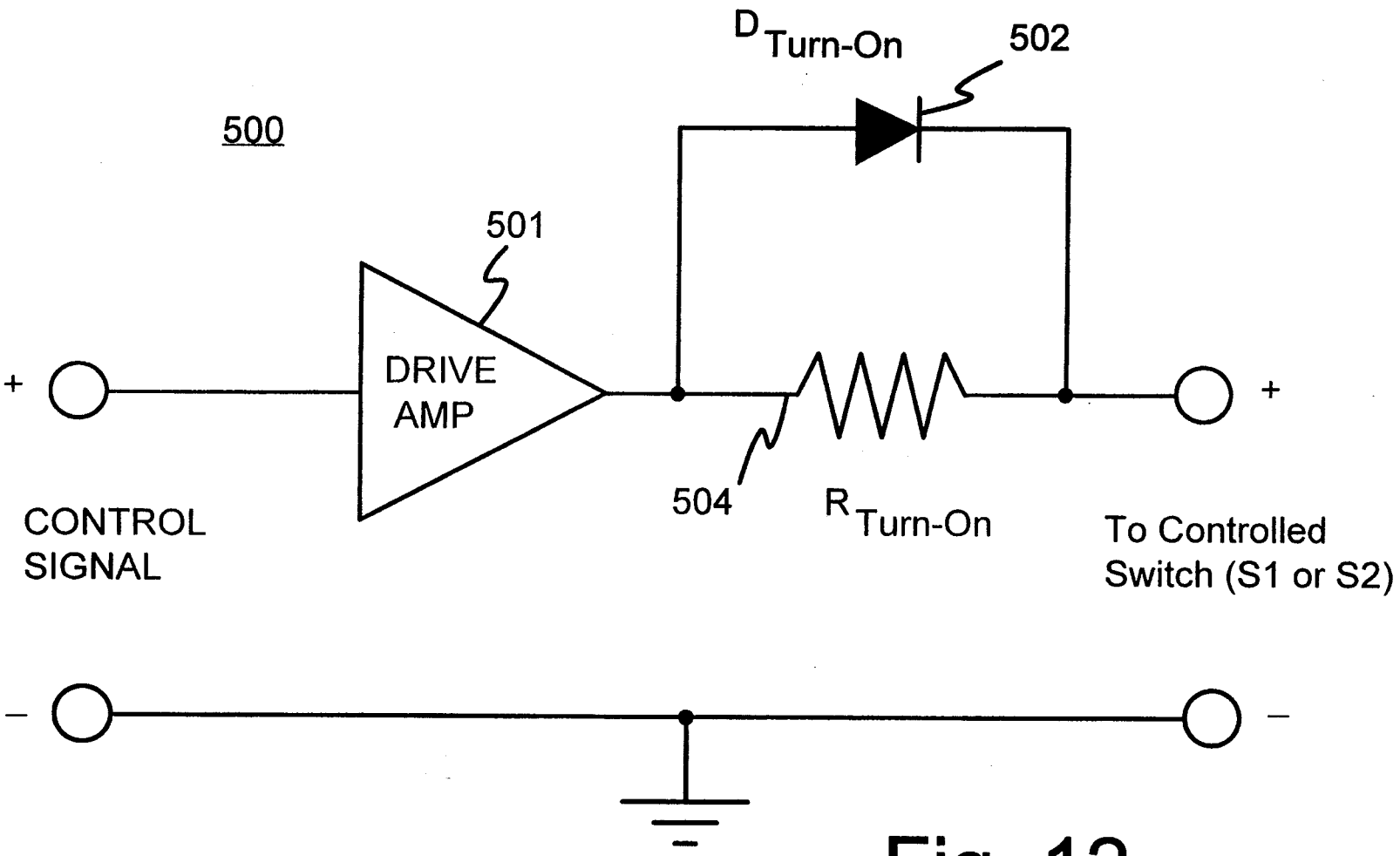
FIG. 12 is a switch driver circuit to ensure a short conduction overlap in accordance with the present invention.

The switch driver 500 in FIG. 12 is added as a refinement to the proposed converter. Since the converter uses controlled switches 110 and 112 during its normal operation, one must make sure that the inductor current has a continuous current path so as to avoid inductive flyback voltages. One way to ensure this is to slightly overlap the conduction of switches 110 and 112. Using the circuit 500 in FIG. 12, the controlled switches 110 and 112 are turned on through the diode 502 $D_{turn\text{-}on}$, while they are turned off through $R_{turn\text{-}off}$504 (the diode is reversed biased when the output of the switch drive amplifier is low). This method of driving the switch results in slightly longer turn-off times for the switches 110 and 112 than their respective turn-on times. Therefore, switches 110 and 112 have a very short conduction overlap, providing a continuous inductor current path.

An improved step-up converter is described herein that has soft start capability to prevent input inrush current and output voltage ringing. In addition, the converter is capable of overcurrent protection to either shut down or limit the output current to safe levels.

Although the present invention has been described in accordance with the embodiments shown in the figures, one of ordinary skill in the art recognizes there could be variations to the embodiments and those variations would be within the spirit and scope of the present invention. Accordingly, many modifications may be made by one of ordinary skills in the art without departing from the spirit and scope of present invention, the scope of which is defined solely by the appended claims.

We claim:

1. A circuit for converting a first voltage to a second voltage and driving a load, the circuit comprising:

a voltage source;

an inductance coupled to the voltage source;

a capacitance coupled between the voltage source and the inductance, the capacitance being coupled in parallel with the load;

a first switching means coupled between the inductance and the voltage source;

a second switching means coupled between the first switching means and the capacitance;

a resistance means coupled to the inductance;

a third switching means coupled to the resistance means and the voltage source;

means for controlling the first, second, and third switching means, the controlling means during normal operation causes the first and second switching means to switch in a complementary fashion and causes the third switching means to remain open, the controlling means during a first soft start cycle step causing the first switching means to remain open and causing the second and third switching means to operate in a complementary fashion, the controlling means during a second soft start cycle step causing the third switching means to remain open and causing the first and second switches to operate in a complementary manner until steady state operation is achieved; and an overcurrent protection circuit, the overcurrent protection circuit including means for sensing the output current of the converting circuit and providing that sensed signal to the controlling means; and means for modifying the operation of the converting circuit if an overcurrent condition is sensed.

2. The circuit of claim 1 in which the first, second and third switching means are Field Effect Transistors.

3. The circuit of claim 1 in which the resistance means comprises a resistor for damping the resonant tank formed by the inductance means and capacitance means (in parallel fashion to the load).

4. The circuit of claim 2 in which the second soft start cycle step occurs after the first soft start cycle step is completed.

5. The circuit of claim 1 in which during the first start cycle a duty cycle of the third switching means is substantially small and is increased toward unity.

6. The circuit of claim 1 in which during the second start cycle a duty cycle of the first switching means is the nominal duty cycle that results in the desired final steady state operation.

7. A step-up converter for converting a source voltage into a higher output voltage for driving a load; step-up converter comprising:

a voltage source;

an inductor coupled to the voltage source;

a capacitor coupled between the voltage source and the inductor, the capacitor being in parallel fashion with the load;

a first switch coupled in series between the inductor and the voltage source;

a second switch coupled in series between the first switch and the capacitor;

a resistor coupled in series with the inductance and the voltage source and a third switch;

a third switching means coupled to the resistor and the voltage source;

a control system for controlling the operation of the first, second and third switches; the control system during normal operation of the converter causing the first and second switches to operate in a complementary fashion and causing the third switch to remain open, the control system during a first soft start cycle step causing the first switch to remain open and causing the second and third switch to operate in a complementary fashion, the control system during a second soft start cycle step causing the third switch to remain open and causing the first and second switches to operate in a complementary manner until steady-state operation is achieved; and an overcurrent protection circuit, the overcurrent protection circuit including means for sensing the output current of the converter and providing that sensed signal to the control system; and means for modifying the operation of the converter if an overcurrent condition is sensed.

8. The converter of claim 7 in which the first, second and third switches are field effect transistors although other types of switches may be used.

9. The converter of claim 7 in which the resistor for damping the resonant tank comprising inductor and load resistor.

10. The converter of claim 8 in which the second soft start cycle step occurs after the first soft start cycle is completed.

11. The converter of claim 7 in which during the first start cycle step a duty cycle of the third switch is increased toward unity from a small initial value.

12. The converter of claim 7 in which during the second soft start cycle step the duty cycle of the first switching means is the nominal duty cycle that results in the desired steady-state operation.

13. The converter of claim 7 in which the modifying means shuts down the converter if an overcurrent condition is sensed.

14. The converter of claim 7 in which the modifying means provides a threshold current that is lower than the overcurrent condition as the output current of the converter.

15. The converter of claim 7 in which the modifying means limits the output of the converter to a pre-determined level.

16. A circuit for converting a first voltage to a second voltage and driving a load, the circuit comprising:

a voltage source;

an inductance coupled to the voltage source;

a capacitance coupled between the voltage source and the inductance, the capacitance being coupled in parallel with the load;

a first switching means coupled between the inductance and the voltage source;

a second switching means coupled between the first switching means and the capacitance;

a resistance means coupled to the inductance;

a third switching means coupled to the resistance means and the voltage source;

means for controlling the first, second, and third switching means; and an overcurrent protection circuit, the overcurrent protection circuit including means for sensing the output current of the converting circuit and providing that sensed signal to the controlling means; and means for modifying the operation of the converting circuit if an overcurrent condition is sensed.

17. The converting circuit of claim 16 in which the modifying means shuts down the converting circuit if an overcurrent condition is sensed.

18. The converting circuit of claim 16 in which the modifying means provides a threshold current that is lower than the overcurrent condition as the output current of the converting circuit.

19. The converting circuit of claim 16 in which the modifying means limits the output of the converting circuit to a predetermined level.

* * * * *